US009321166B2

(12) United States Patent
Roye

(10) Patent No.: US 9,321,166 B2
(45) Date of Patent: Apr. 26, 2016

(54) MIXING BLADE FOR CEMENTITIOUS MATERIAL

(71) Applicant: Samuel L. Roye, Capitola, CA (US)

(72) Inventor: Samuel L. Roye, Capitola, CA (US)

( * ) Notice: Subject to any disclaimer, the term of this patent is extended or adjusted under 35 U.S.C. 154(b) by 509 days.

(21) Appl. No.: 13/662,028

(22) Filed: Oct. 26, 2012

(65) Prior Publication Data

US 2014/0119152 A1 May 1, 2014

(51) Int. Cl.
*B01F 13/00* (2006.01)
*B25G 1/10* (2006.01)
*B25G 3/26* (2006.01)

(52) U.S. Cl.
CPC *B25G 1/102* (2013.01); *B25G 3/26* (2013.01); *B01F 13/002* (2013.01)

(58) Field of Classification Search
CPC ..... B01F 13/002; B01F 13/0033; A01B 1/08; A01B 1/10; A01B 1/12
USPC ..... 366/129; 172/371
See application file for complete search history.

(56) References Cited

U.S. PATENT DOCUMENTS 202,563 A * 4/1878 Masterson ..... A01B 1/08 172/371
1,650,463 A * 11/1927 Pitts ..... A01B 1/08 172/371
1,777,029 A * 9/1930 Bradford ..... A01B 1/08 172/381
1,929,128 A * 10/1933 Vidmar ..... A01B 1/06 172/371
2,011,062 A * 8/1935 Masamitsu ..... A01B 1/08 172/371
2,283,322 A * 5/1942 Edell ..... A01B 1/08 30/299
2,315,074 A * 3/1943 Olsen ..... A01B 1/08 172/371
3,143,984 A * 8/1964 Morasch ..... A01B 1/08 111/7.1
5,947,039 A 9/1999 Lundgren et al.
D698,619 S * 2/2014 Schnabel ..... D8/11
2002/0112865 A1* 8/2002 Murtagh ..... A01B 1/08 172/371
2008/0043571 A1* 2/2008 Bizzell ..... B01F 7/00125 366/343

FOREIGN PATENT DOCUMENTS

CA 2246091 A1 * 3/2000 ..... A01B 1/08

* cited by examiner

*Primary Examiner* — Charles Cooley
*Assistant Examiner* — Marc C Howell
(74) *Attorney, Agent, or Firm* — Barry N. Young

(57) ABSTRACT

A tool for infecting fluid into and mixing with cementitious material includes a V-shaped or triangularly shaped blade connected to a tubular handle, the blade having a central open area, a top edge and interior edges. The top and interior edges have a plurality of notched cut-outs that together with the edges of the blade form corners for engaging and mixing the cementitious material and fluid as the blade moves through it.

10 Claims, 6 Drawing Sheets

MIXING BLADE FOR CEMENTITIOUS MATERIAL

BACKGROUND

This invention relates generally to tools for mixing cementitious materials, and further to improved mixing blades for hand tools such as hoes and the like for mixing water or other fluids with dry cementitious materials to form slurries.

Cementitious materials such as concrete, mortar, tile grout, plaster and the like typically comes in bags as a "dry mix". In order to be used, the dry mix material must be mixed with water or other fluids to form a slurry having an appropriate consistency. Generally, this is done by gradually adding water to the dry mix material and stirring or the water and the material using a hand tool such as a hoe, a trowel, or the like to completely and thoroughly mix the material and the water to form a uniform slurry of the desired consistency.

U.S. Pat. No. 5,947,039 to Lundgren et. al discloses a hand-held water injecting tool for gradually adding water to and mixing dry cementitious materials such as concrete. The Lundgren tool comprises a hoe-like device having a tubular handle for conveying water to a blade attached to a lower water outlet end of the handle, a connection for a conventional garden hose at the upper water inlet end of the handle, and a control valve to control the flow of water through the tubular handle to the blade. The lower end of the handle to which the blade is attached is flattened or crimped to form a pair of parallel ducts or channels that communicate with the interior of the handle to convey water from within the tubular handle to outlets at the ends of the ducts or channels to the surface of the blade. The control valve allows water to be added in a controlled manner to the dry material during mixing.

Lundgren discloses two different blade structures. The first is a solid planar triangularly-shaped blade having a lower end or tip with a rounded radius and having a top angled flange which extends outwardly from the plane of the blade to impart additional strength and stiffness to the blade. The triangularly-shaped blade is attached to the lower crimped end of the handle by fasteners, and is disclosed as facilitating slurryfying of cementitious dry mix materials by making penetration and movement through such materials less difficult. The second blade has an arrow-like or V-shaped design with a winged appearance with a pair of opposed left and right wing portions extending upwardly from a rounded radius tip, and has a tang bisecting the wing portions that extends into the lower crimped portion of the tubular handle for attachment thereto.

The triangularly-shaped blade of Lundgren operates in a similar way to a conventional hoe. The triangular shape of the blade allows the pointed end to penetrate the mixture more easily. However, the blade does not have the same area as a conventional hoe and it does not work well to mix thoroughly the dry cementitious materials, particularly concrete, and water to form the desired slurry. Also, the top angled flange of the blade allows materials to coagulate in lumps behind the flange and at the back of the blade. While the V-shaped blade performs somewhat better than the triangularly-shaped solid blade, it also does not perform satisfactorily in mixing concrete and other dry cementitious materials with water. Bagged concrete contains gravel, typically ⅜ inch pea gravel, which makes it more difficult than other types of cementitious materials to mix thoroughly into a uniform, consistent slurry. The angled sides of both blades allow the blades to scrape the sides of a wheelbarrow or other mixing container. However, their rounded tips do not allow the blades to scrape effectively the bottom of the mixing container.

There is a need for improved tools for mixing cementitious materials, including fluid injecting tools of the type disclosed in the Lundgren et. al patent, and it is to these ends that the present invention is directed.

SUMMARY OF THE INVENTION

The invention provides improved mixing blades for cementitious material for use with hand tools, and improved fluid injecting tools using such blades for mixing cementitious materials that address the foregoing and other known problems of available mixing tools. Blades and tools employing the improved blades in accordance with the invention allow for more thorough, uniform and efficient mixing of cementitious materials.

In one aspect, the invention provides a tool having a planar blade with a central bottom section and a straight bottom edge, and a pair of legs extending upwardly and outwardly at angles from the central bottom section. The legs each have an outer lateral edge, an interior lateral edge and a top edge. The interior lateral and top edges of the legs have a plurality of notched cut-outs that together with the lateral interior and top edges constitute a plurality of mixing edges with corners for engaging and mixing the cementitious materials and fluid as the blade moves therethrough. The blade has also has a connecting tang within the plane of the blade.

In another aspect, the invention provides a tool having a planar triangularly-shaped blade with a triangularly shaped central opening, a pair of side legs having outer and interior lateral edges extending upwardly inclined from a bottom portion of the blade, and a top member extending between upper ends of the side legs. The bottom portion of the blade has a straight bottom edge; the top member has a top edge with a plurality of notched cut-outs that together with the top edge and lateral edges of the legs constitute a plurality of mixing edges for engaging and mixing the cementitious materials and fluid as the blade is moved through it. The tool further has a connecting tang within the plane of the blade that extends from the top member.

In still another aspect a blade in accordance with the invention is connected to a handle having an inner bore formed for connection to a fluid supply, and a control mechanism for controlling the amount of fluid flowing through the handle inner bore to the blade.

DESCRIPTION OF PREFERRED EMBODIMENTS

The invention is particularly well adapted for use with fluid injecting hand tools for mixing cementitious materials of the type disclosed in the above-reference U.S. Pat. No. 5,947,039 to Lundgren et. al, the disclosure of which is incorporated by reference herein, and will be described in that context. It will be appreciated however that this is illustrative of only one utility of the invention and that the invention is applicable also to other types of tools.

Figure 1:
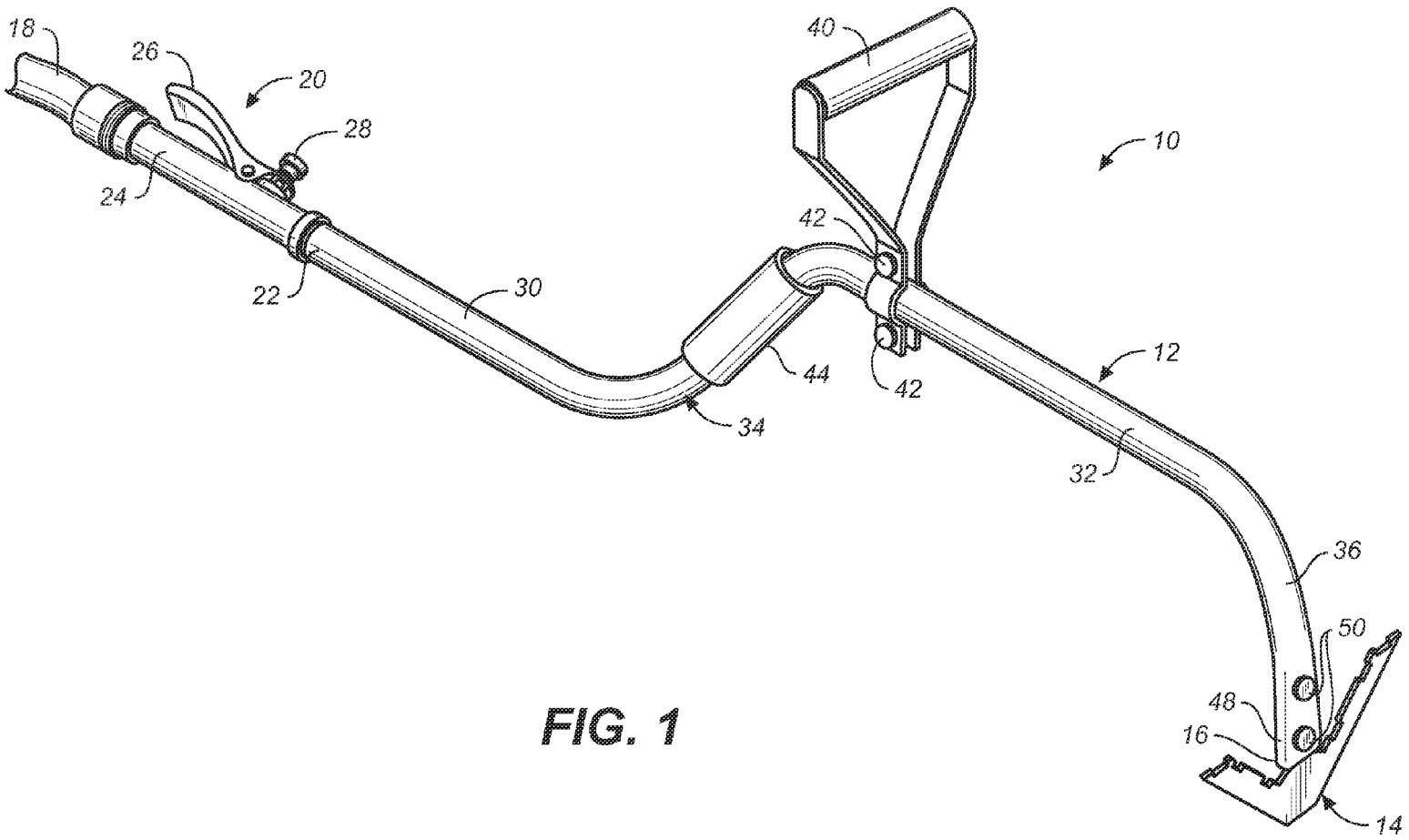
FIG. 1 is a perspective view of an improved fluid injecting tool in accordance with the invention employing a first embodiment of a mixing blade in accordance with the invention for mixing cementitious materials.
Figure 2:
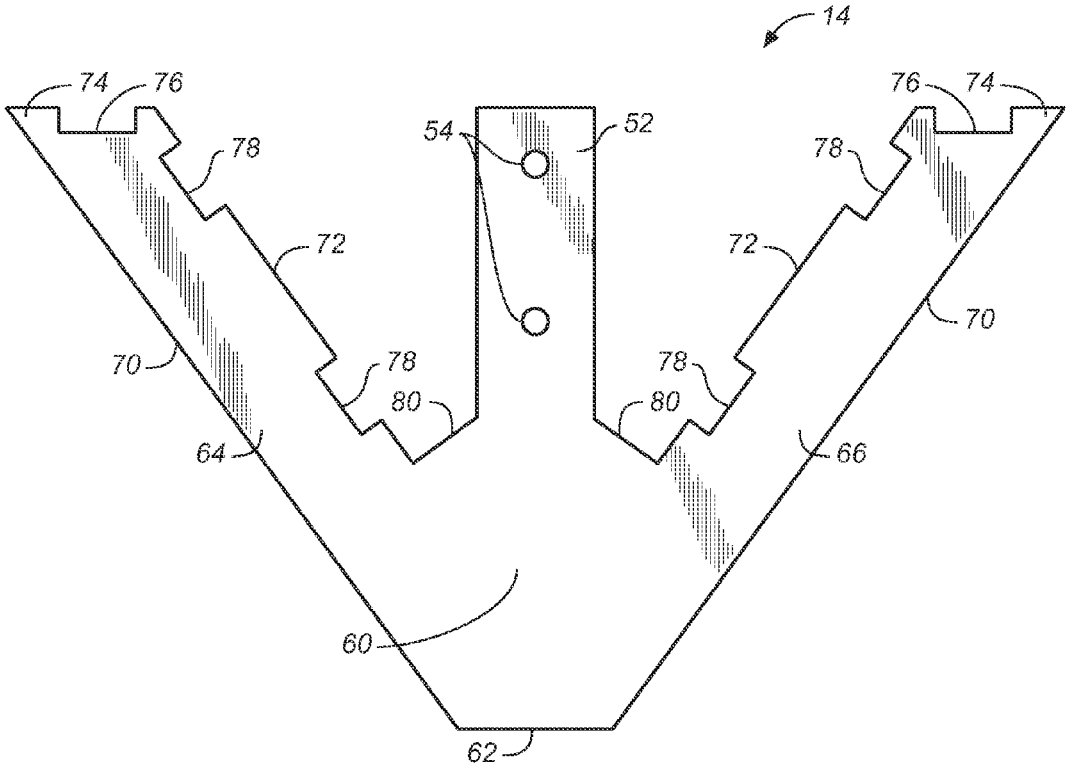
FIG. 2 is an front elevation view of the first embodiment of a mixing blade in accordance with the invention.
Figure 3:
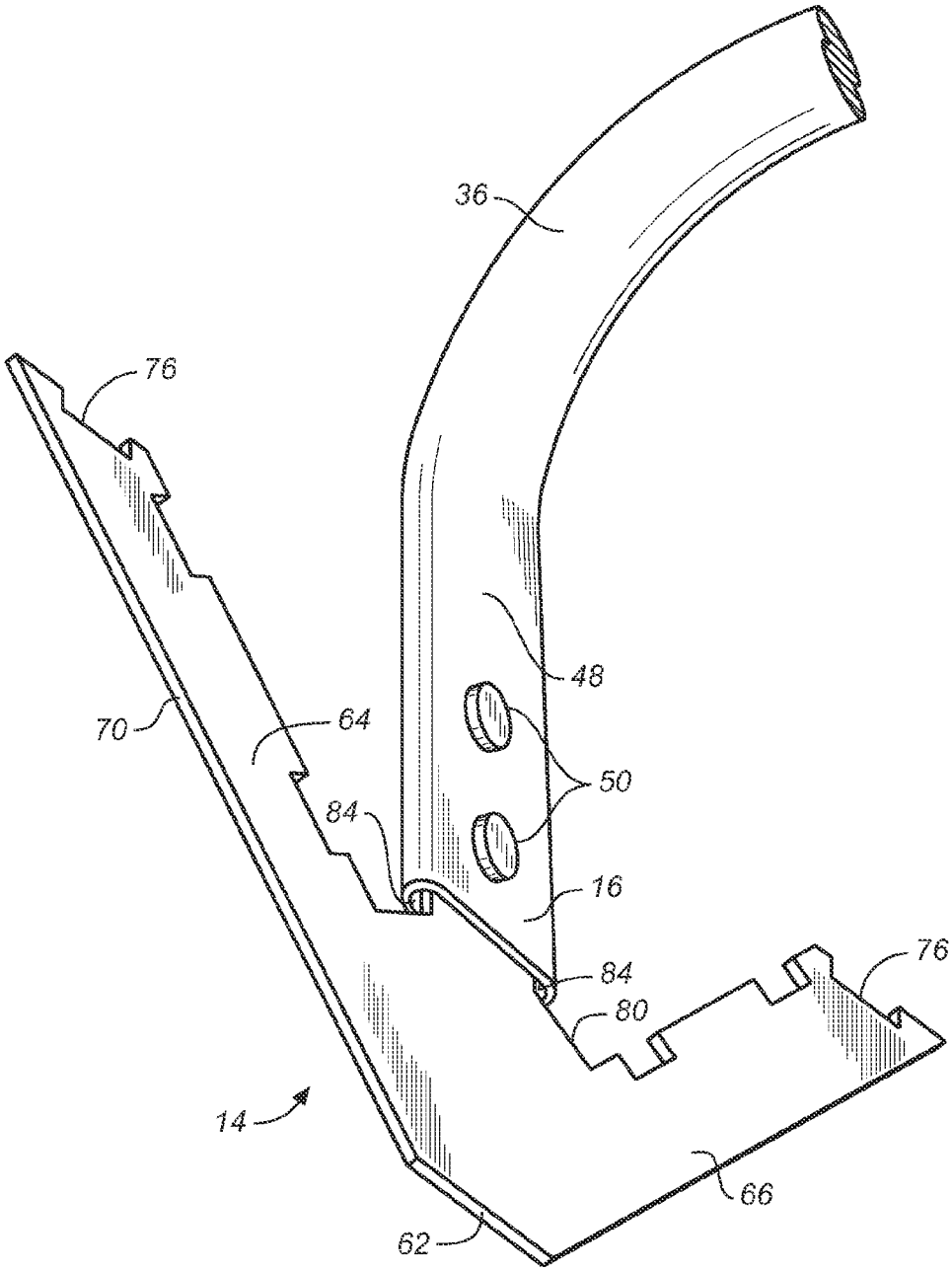
FIG. 3 is a perspective view illustrating in more detail the attachment of the first embodiment of the mixing blade of FIG. 2 to the handle of the fluid injecting tool of FIG. 1.
Figure 4:
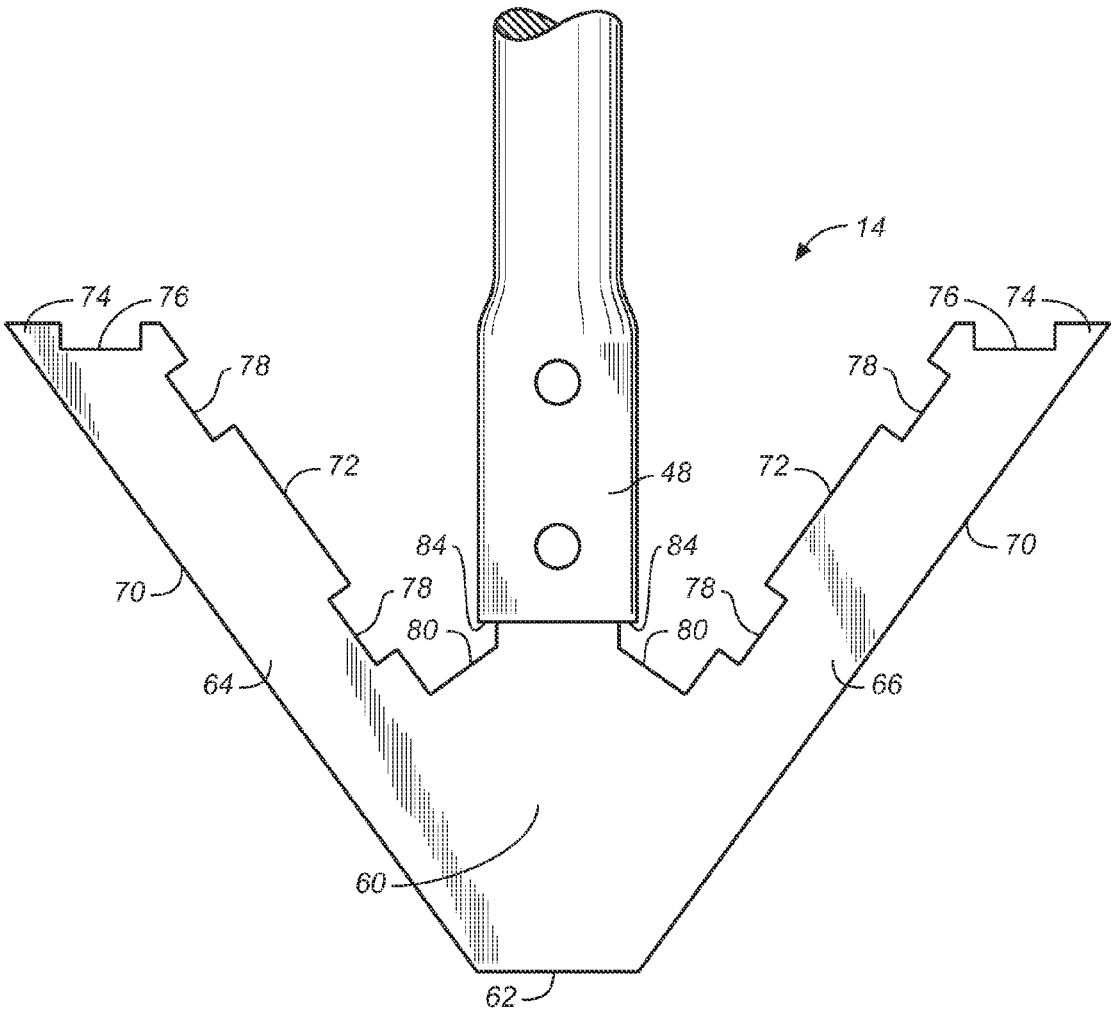
FIG. 4 is a front elevation view showing the attachment of the first embodiment to the mixing blade to the handle of the mixing tool of FIG. 1.

FIG. 1 is a perspective view of a hand-held water injecting tool 10 similar to that disclosed in the above-referenced Lundgren patent for mixing cementitious materials. Tool 10 may have a generally circuitous rigid tubular handle 12, such as shown and described in the Lundgren patent, the tool having a blade 14 connected to a lower working end 16 of the tubular handle, and a water supply 18, such as a hose, connected to a control valve assembly 20 located at an upper water inlet end 22 of the tubular handle. Unlike the pistol-grip handle and water control valve of Lundgren, the control valve assembly 20 of the tool 10 of FIG. 1 preferably comprises a straight tubular handgrip portion 24 having a hand or thumb operated lever 26 to open and close a valve 28 to control the flow of water into the interior of the tubular handle 12 from water supply hose 18. The straight handgrip portion 24 is preferable to the pistol grip handle the Lundgren since it facilitates holding the tool 10 and operating water injection. Circuitous tubular handle 12 may comprise an integral piece of rigid tubing having several distinct differently shaped portions. As shown in the figure, the handle may include an upper straight tubular portion 30, a lower straight tubular portion 32, a curved middle portion 34 connecting tubular portions 30 and 32, and another curved portion 36 connected to the lower straight portion 32 and the lower end 16 of the handle 12. A handgrip 40 may be affixed to the lower handle portion 32 adjacent to the middle portion by fasteners such as bolts and nuts 42 so that its location on the straight portion 32 can be adjusted to a desired position along the length of portion 32. Another handgrip 44, as of tubular rubber material or the like, also may be located about the curved middle portion 34 of the handle 12. As illustrated in FIGS. 1, 3 and 4, the lower end 16 of the tubular handle may be flattened or crimped as shown at 48 for connection to blade 14, as by fasteners 50. As shown in FIGS. 2 and 3, blade 14 may have a projecting tang 52 that is within the plane of the blade and sized to be received within the interior of the flattened or crimped portion 48 of the handle, and fasteners 50, for example, rivets, may go through the flattened portion 48 and the tang 52 for connection of the blade to the tubular handle 12. Tang 52 may have apertures 54 for receiving the fasteners 50.

FIGS. 1-4 illustrate a first embodiment of a mixing blade 14 in accordance with the invention. As shown best in FIGS. 2, 3 and 4, blade 14 is rigid V-shaped planar member having a central bottom blade section 60 from which tang 52 extends, a straight bottom edge 62, and a pair of legs 64, 66, respectively, extending outwardly and upwardly at inclined angles from the central blade section 60 and the bottom edge 62 of the blade to impart a V-shape to the blade. Tang 52 may bisect the legs and extend upwardly from the central section of the member about a central axis of the blade for connection to the handle of tool 10. Each of the legs 64, 66 of the blade may have an outer lateral edge 70 extending upwardly from bottom edge 62, an interior lateral edge 72 parallel to the outer lateral edge 70, and a top edge 74 that extends between the outer and interior lateral edges of each leg, is generally parallel to bottom edge 62, and is normal to the tang 52 and the central axis of the blade. The interior lateral edges of the legs 64, 66 face inwardly towards the tang 52. The top edges 74 of the blade legs 64, 66 may have one or more notched cut-outs, 76 formed therein (one cut-out being shown in the figures), and the interior lateral edges 72 of the legs may also have a plurality of cut-outs 78 formed therein, as illustrated in FIGS. 1-4. The blade may also have angled edges 80 at the top of central section 60 that extend at a downwardly sloping angle from the edges of the tang 52 and relative to a central axis of the blade generally normal to the lateral interior edges 72 of the legs 64, 66.

In contrast to such known mixing blades, blade 14 of FIGS. 1-4 is particularly effective for mixing bagged concrete, although it will also mix other types of cementitious materials such as mortar, grout, sheetrock compound, plaster and the like. Bagged concrete comprises sand, cement and gravel, typically ⅜ inch peak gravel, which are pre-blended during the manufacturing process. Due to its gravel content, bagged concrete is particularly difficult to mix thoroughly and uniformly using a conventional hoe or using the triangularly-shaped and V-shaped blades disclosed in the Lundgren et. al patent. The effectiveness of blade 14 in mixing concrete is due to the design of blade, and particularly to its plurality of cut-outs 76, 78 on the top and interior lateral edges of the legs. Blade 14 has thirty-three mixing edges that contact and move the gravel in the concrete as the blade is moved through the material. The mixing edges provide points of contact that spin the gravel, sand and cement and facilitate the introduction, stirring and thorough mixing of water with the dry mix to provide a uniform slurry. Additionally, the straight flat bottom edge 62 of the blade scrapes and moves the mixture more efficiently along the bottom of the wheelbarrow or mixing container. This straight bottom edge moves more material than the rounded bottom tips of the blades of the Lundgren patent.

Further, the elongated outer lateral edges of the legs of blade 14 scrape the sides of the wheelbarrow or mixing container to a greater degree and force sand, gravel and cement up through the mixing edges afforded by the cut-outs. The combination of the mixing edges, flat edge at the bottom and the wind V-shape of the blade provide for easier and more efficient blending while injecting water into the sand, cement and gravel mix. Additionally, as best illustrated in FIGS. 3-4, the sloped edges 80 of the middle section 60 of the blade are located adjacent to the outlets 84 of the channels formed on opposite sided if the tang 52 by the crimped end 48 of tubular handle 12. The sloped edges 80 of the blade facilitate the distribution of water flowing from the outlets 84 in the tubular handle evenly over the blade surface and afford more even distribution of water into the mix.

Blade 14 of FIGS. 1-4 is preferably formed by laser cutting the blade from a ⅛ inch thick plate of 410 stainless steel or galvanized steel, although it may be formed as well from other types and different thicknesses of materials. Laser cutting is preferable to stamping the blade from a metal plate as it produces sharper, more pointed corners for the notches, which interact better with the gravel and other constituents of the concrete.

Figure 5:
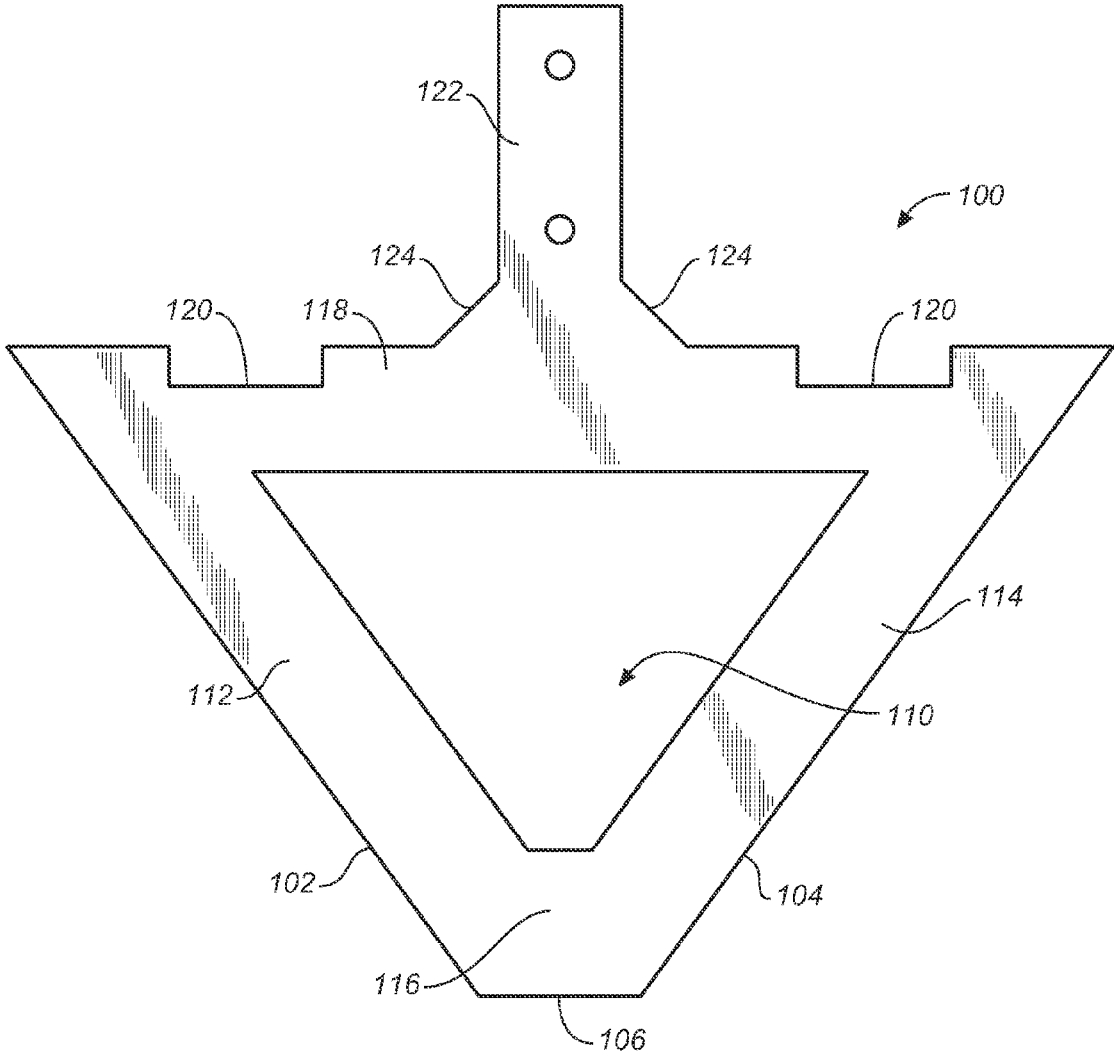
FIG. 5 is a front elevation view of an embodiment of a second mixing blade in accordance with the invention.

FIG. 5 illustrates a second embodiment of a blade 100 in accordance with the invention that may be used with tool 10. As shown, blade 100 comprises a triangularly shaped blade member having lateral side edges 102, 104 which slope upwardly from a straight bottom edge 106, a top edge 108 and a central triangularly shaped cut-out or opening 110 through the blade that preferably matches the triangular shape of the blade. The straight bottom edge truncates the triangular shape of the blade at the tip region. Opening 110 may be sized to form a pair of side legs 112, 114 that are generally similar in size and shape to legs 64 and 66 of V-shaped blade 14, and that are upwardly inclined at an angle from a bottom portion 116 of the blade 100. A top member 118 may extend between upper ends of the legs 112 and 114. The top member 118 may be formed with one or more notches or cut-outs 120 in its top edge 108. The blade 100 thus has a generally triangular open frame shape. The cut-outs may be similar to the cut-outs 76 described for blade 14. Blade 100 may have a projecting tang 122 extending upwardly from top member 118 within the plane of the blade and centrally located about a vertical axis of the blade for connection to a tubular handle such as handle 12 of water injecting tool 10. The tang may have a pair of downwardly angled edges 124 extending between the side edges of the tang and the top edge 108 of the blade. The angled edges 124 function similarly to angled edges 80 of blade 14 to distribute water impinging upon them evenly from the nozzles in the handle across the blade and into the mix.

Blade 100 is intended to be a general purpose mixing blade that will mix many different types of cementitious materials. It is somewhat better than blade 14 for mixing tile grout, sheetrock compound, plaster and mortar, but can also be used to mix bagged concrete as well. Tile grout, sheetrock compound, plaster and mortar do not contain gravel, as does concrete, and these materials tend to have a watery dough or paste-like consistency. The triangularly-shaped opening 110 in the center of blade 100 allows such materials to flow through the opening and to be to be forced to the front of the blade as it is moved through the material, so that water or other fluids may be controllably introduced into the materials. Blade 100 is well suited for mixing cementitious materials that do not contain gravel. In addition, the cut-outs 120 in the top member 118 of the blade 100 enable it to also be used for mixing concrete or other materials containing gravel by providing edges that spin the gravel as the blade is moved through the material.

The straight bottom edge 106 and the lateral side edges 102, 104 of blade 100 function in a similar way to that described for the straight bottom and lateral sides of blade 14, and blade 100 with water injection offers significant advantages over a common well-known mortar hoe. Blade 100 may also be used as a watering hoe or composting hoe. It may be formed by laser cutting a plate of galvanized or stainless steel in a similar manner to that described above in connection with blade 14.

Figure 6:
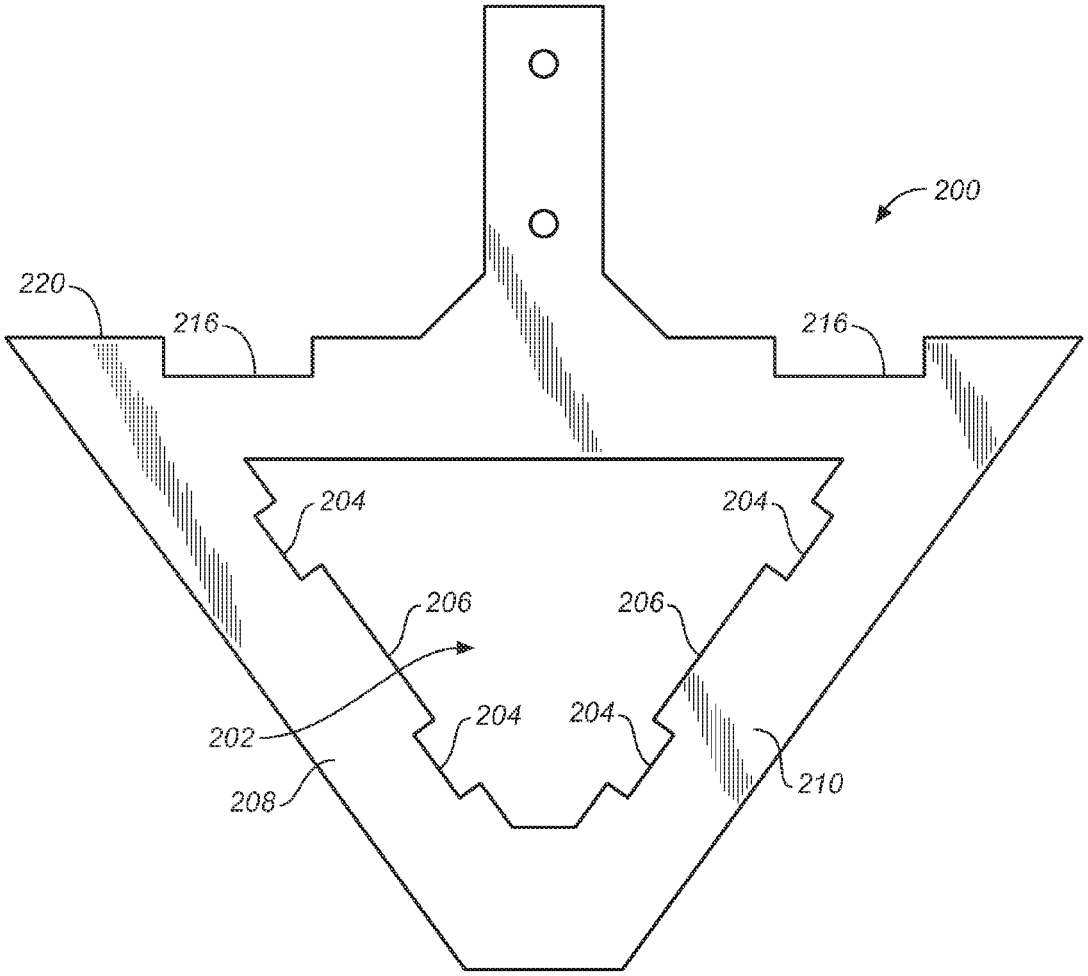
FIG. 6 is a front elevation view of a third embodiment of a mixing blade in accordance with the invention.

FIG. 6 illustrates a third embodiment of a multi-purpose mixing blade 200 in accordance with the invention that may be used with tool 10. Blade 200 may be substantially the same as blade 100 of FIG. 5, comprising a triangularly-shaped blade having a triangularly-shaped central opening 202, except that blade 200 has cut-outs 204 formed in the interior edges 206 of lateral side legs 208 and 210 within the central triangularly-shaped opening 202. As with blade 100, blade 200 may have cut-outs 216 formed in a top edge 220 of the blade.

Blade 200 functions in a similar way to that described for blades 14 and 100. Cut-outs 204 and 216 function as previously described to provide edges for spinning gravel in concrete mix, and the central opening 202 in the blade is effective for mixing other types of materials such as mortar and grout, as described above for blade 100.

Blades 100 and 200 of FIGS. 5 and 6, respectively, may be formed in a similar manner to that described for blade 14, preferably by laser cutting the blades from a plate of stainless steel or galvanized steel. As will be appreciated, however, the blades may also be formed from other different types of materials. Additionally, it will also be appreciated that while blades in accordance with the invention have been described in connection with a fluid injecting tool of the type described in the above-referenced Lundgren et. al patent the blades may also be used effectively with other types of tools, including tools that are not fluid injecting.

While the foregoing has been with respect to particular embodiments of the invention, it will be appreciated by those skilled in the art that changes in these embodiments may be made without departing from the principles and the spirit of the invention, the scope of which is defined in the appended claims.

The invention claimed is:

1. A tool for mixing a concrete mixture containing sand, cement, gravel and a fluid, comprising:

a planar blade having a central bottom section with a straight bottom edge, a pair of legs extending upwardly and outwardly at angles from the straight bottom edge to impart to the blade a generally V-shape with said straight bottom edge truncating the V-shape, the legs each having an outer lateral edge, an interior lateral edge and a top edge, and the interior lateral and top edges of said legs having a plurality of notched rectangular-shaped cut-outs formed therein, said cut-outs in said lateral interior edges and in said top edges being sized to receive said gravel within said cutouts and to provide a plurality of mixing edges for engaging said gravel and mixing said gravel, sand, cement and fluid as the blade is moved therethrough, and a connecting tang within the plane of the blade.

2. The tool of claim 1, wherein said tang projects upwardly between said legs from said central bottom section and at substantially a right angle to said straight bottom edge.

3. The tool of claim 2, wherein said blade has opposed inclined edges extending between the interior edges of said legs and adjacent edges of said tang.

4. The tool of claim 3 further comprising a tubular handle, said tang being received within and connected to said handle, said handle being formed to enable said blade to be inserted substantially vertically into said concrete mixture, and having openings for conveying fluid onto said inclined edges, the inclined edges distributing the fluid over said a portion of said central bottom section and said legs and into said concrete mixture.

5. The tool of claim 1, wherein said mixing edges are formed to engage and spin said gravel in said concrete mixture as the blade moves therethrough to facilitate said mixing.

6. The tool of claim 1, wherein the outer lateral edges of the legs are straight and free from cut-outs.

7. A tool for mixing a concrete mixture containing sand, cement and gravel with a fluid, comprising:

a handle having an upper end for connection to a fluid supply, a lower end, an inner bore for conveying the fluid from the upper end to the lower end, and a control mechanism for controlling the amount of fluid flowing through the handle inner bore; and a blade connected to the lower end of the handle, the blade comprising a planar member having a central bottom section with a straight bottom edge, a pair of legs extending upwardly and outwardly at angles from the straight bottom edge to impart to the blade a generally V-shape with the straight bottom edge truncating the V-shape, the legs each having an outer lateral edge, an interior lateral edge and a top edge, and the interior lateral and top edges of said legs having a plurality of notched rectangular-shaped cut-outs formed therein, said cut-outs in said lateral interior and top edges being sized to receive said gravel within said cut-outs and forming a plurality of mixing edges for engaging said gravel and mixing said gravel, sand, cement and fluid as the blade is moved therethrough, and a tang received within the bore of the handle for connecting the blade to the handle.

8. The tool of claim 7, wherein the outer lateral edges of the legs are straight and free from cut-outs.

9. The tool of claim 7, wherein said handle is formed to enable said blade to be inserted substantially vertically into the mixture and moved therethrough.

10. The tool of claim 7, wherein said mixing edges are formed to engage and spin said gravel in said mixture as the blade moves through the mixture.

* * * * *